US010327985B2

(12) United States Patent
Aelen et al.

(10) Patent No.: US 10,327,985 B2
(45) Date of Patent: Jun. 25, 2019

(54) CARDIO PULMONARY RESUSCITATION QUALITY FEEDBACK SYSTEM

(71) Applicant: KONINKLIJKE PHILIPS N.V., Eindhoven (NL)

(72) Inventors: Paul Aelen, Eindhoven (NL); Simone Cornelia Maria Anna Ordelman, 's-Hertogenbosch (NL); Pierre Hermanus Woerlee, Valkenswaard (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 664 days.

(21) Appl. No.: 14/911,307

(22) PCT Filed: Aug. 13, 2014

(86) PCT No.: PCT/EP2014/067376
§ 371 (c)(1),
(2) Date: Feb. 10, 2016

(87) PCT Pub. No.: WO2015/022387
PCT Pub. Date: Feb. 19, 2015

(65) Prior Publication Data

US 2016/0199251 A1 Jul. 14, 2016

(30) Foreign Application Priority Data

Aug. 13, 2013 (EP) ..... 13180271

(51) Int. Cl.
*A61H 31/00* (2006.01)

(52) U.S. Cl.
CPC ..... *A61H 31/005* (2013.01); *A61H 31/007* (2013.01); *A61H 2230/30* (2013.01)

(58) Field of Classification Search
CPC .... A61H 31/00; A61H 31/004; A61H 31/005; A61H 31/007; A61H 31/006;
(Continued)

(56) References Cited

U.S. PATENT DOCUMENTS 3,489,140 A 1/1970 Mullikin
5,496,257 A 3/1996 Kelly
(Continued)

FOREIGN PATENT DOCUMENTS

EP 1854444 A1 11/2007
EP 1913923 A1 4/2008
(Continued)

OTHER PUBLICATIONS

Kolar et al: "Partial Pressure of End-Tital Carbon Dioxide Successful Predicts Cardiopulmonary Resuscitation in the Field: A Prospective Observational Study"; Critical Care, vol. 12, No. 5, 2008, pp. 1-13.

*Primary Examiner* — Michael J Tsai

(57) ABSTRACT

A system for providing feedback regarding chest compressions in CPR, an automated resuscitation device and a method for providing feedback regarding chest compressions in CPR, are based upon a quality measure for cardio pulmonary resuscitation. The system includes a measuring unit, a processor, an indicator unit, and a sensor and display. The measuring unit measures an arterial blood pressure of a patient. The processor calculates a blood pressure CPR quality index based on the measured blood pressure as a function of time. The indicator unit provides an indication of the blood pressure CPR quality indicator. The sensor registers a depth of compression of CPR and the display displays a signal indicating CPR compression depth as a function of time.

15 Claims, 4 Drawing Sheets

(58) Field of Classification Search
CPC ..... A61H 31/008; A61H 2031/001; A61H 2031/002; A61H 2031/003
See application file for complete search history.

(56) References Cited

U.S. PATENT DOCUMENTS

| | | | | |
|---|---|---|---|---|
| 2007/0060785 | A1 | 3/2007 | Freeman et al. | |
| 2007/0276300 | A1 | 11/2007 | Olson et al. | |
| 2008/0146974 | A1 | 6/2008 | Lund et al. | |
| 2008/0208082 | A1 | 8/2008 | Nysaether et al. | |
| 2008/0300517 | A1* | 12/2008 | Nysaether | A61H 31/005 601/41 |
| 2008/0300518 | A1 | 12/2008 | Bowes | |
| 2010/0022886 | A1* | 1/2010 | Ayati | A61B 5/6822 600/454 |
| 2010/0198118 | A1 | 8/2010 | Itnati | |
| 2011/0201979 | A1* | 8/2011 | Voss | A61H 31/004 601/41 |
| 2011/0301511 | A1* | 12/2011 | Freeman | A61H 31/005 601/41 |
| 2012/0010543 | A1 | 1/2012 | Johnson et al. | |
| 2012/0259156 | A1 | 10/2012 | Freeman | |
| 2013/0296727 | A1* | 11/2013 | Sullivan | A61B 5/046 600/513 |

FOREIGN PATENT DOCUMENTS

| | | | |
|---|---|---|---|
| EP | 1932502 | A1 | 6/2008 |
| EP | 2343097 | A2 | 7/2011 |
| GB | 2465817 | A | 6/2010 |
| JP | 2010528722 | A | 8/2010 |
| WO | 2004073787 | A2 | 9/2004 |
| WO | 2006005557 | A1 | 1/2006 |
| WO | 2006088373 | A1 | 8/2006 |
| WO | 2007057825 | A2 | 5/2007 |
| WO | 2009109595 | A1 | 9/2009 |
| WO | 2011153356 | A1 | 12/2011 |
| WO | 2013025406 | A1 | 2/2013 |

* cited by examiner

CARDIO PULMONARY RESUSCITATION QUALITY FEEDBACK SYSTEM

CROSS-REFERENCE TO PRIOR APPLICATIONS

This application is the U.S. National Phase application under 35 U.S.C. § 371 of International Application No. PCT/EP2014/067376, filed on Aug. 13, 2014, which claims the benefit of European Patent Application No. 1318027.2, filed on Aug. 13, 2013. These applications are hereby incorporated by reference herein.

FIELD OF THE INVENTION

The present invention relates to a system for providing compression feedback based on a new quality measure for cardio pulmonary resuscitation.

BACKGROUND OF THE INVENTION

Cardiac arrest (CA) is one of the main causes of death in the western world. After the heart has stopped pumping, death is unavoidable unless acute medical care is available. The resulting ischemia disturbs a wide range of cell processes; this eventually leads to cell death. It has been reported that the probability for survival after cardiac arrest decreases exponentially with time. To slow down this decay, Cardio Pulmonary Resuscitation (CPR) has to be performed to obtain a minimum amount of perfusion to vital organs. Cardio Pulmonary Resuscitation (CPR) guidelines prescribe a standard compression depth and frequency (i.e. 100 compressions per minute at a depth of 5.0 cm). This prescribed depth and frequency are person independent. However, the compression depth and frequency that generate optimal blood flows vary between people. To optimally resuscitate a patient, the quality of CPR has to be assessed in some way. In the experimental setting this can be done by measuring blood flows (e.g. carotid or aortic flow) or coronary perfusion pressure (CPP).The CPP measures the pressure drop over the coronary vessels of the heart (Aortic pressure—Right Atrial pressure). However these values require precise and timely placement of measurement catheters, which is not practical during normal clinical practice. In clinical practice, some non- or minimally invasive techniques are being used as surrogate marker of CPR quality. The highest point of expired carbon dioxide trace (End tidal CO2, ETCO2) of a breath is believed to give some information on the quality of CPR. ETCO2 is shown to rise when the heart starts beating on its own (Return of Spontaneous Circulation, ROSC). While giving some indication of the CPR quality, the ETCO2 is influenced by changes in ventilation minute volume (i.e. ventilation frequency and volume), ventilation/perfusion ratio and medication. Further, it takes a significant amount of time (tens of seconds) for ETCO2 to reach a new steady state. Giving feedback on this parameter is therefore not an easy task. No quantitative feedback algorithms/methods exist yet for using this parameter. In this disclosure it is proposed to use certain features of the blood pressure as quality of CPR indicator.

There are a number of devices that measure CPR quality in term of guideline adherence, i.e. giving the prescribed compression depth and frequency. These feedback devices are however not suitable for personalization of CPR.

A system for providing feedback on chest compression in CPR is for example described in EP 1 932 502. The system measures and processes chest compressions and provide feedback to the user with respect to the characteristics of the compressions.

An apparatus for indicating cardiac output comprises means for monitoring a patient's transthoracic impedance and generating a corresponding impedance signal is described in WO2009/109595.

US 2012/259156 A1 describes a device for coordinated resuscitation perfusion support. A system capable of providing electromagnetic stimulation of physiological tissue to supplement the effect of manual CPR is described. Use of different physiological input signals and different compression parameters are proposed.

US 2007/060785 A1 describes a medical device for assisting a user in manually delivering e.g. CPR. In an embodiment, an ultrasonic sensor for blood flow is mentioned in combination with CPR, wherein an estimated blood flow is used to determine timing of feedback cues delivered to a user.

The inventor of the present invention has appreciated that an improved system, apparatus and method is of benefit, and has in consequence devised the present invention.

SUMMARY OF THE INVENTION

It would be advantageous to achieve a device or system to provide physiological CPR quality feedback to persons performing resuscitation or to automatically optimize CPR compression depth. In general, the invention preferably seeks to mitigate, alleviate or eliminate one or more of the above mentioned disadvantages singly or in any combination. In particular, it may be seen as an object of the present invention to provide a system that solves the above mentioned problems, or other problems, of the prior art or at least provides an alternative solution to the prior art.

To better address one or more of these concerns, in a first aspect of the invention a system for providing feedback regarding chest compressions in Cardio Pulmonary Resuscitation (CPR) in accordance with claim 1 is proposed. The system comprises a measuring unit providing a measure of arterial blood pressure of a patient. The measuring unit may provide the measure at a single point in time, or over a period of time, while CPR is being performed. The system may further comprise a processor registering data from the measuring unit, the processor being configured to obtain arterial blood pressure of the patient for a time period while CPR is being performed, and the processor being configured to calculate a blood pressure CPR quality indicator using the blood pressure as a function of time. This data may be stored in a memory or data storage. The processor may be configured to calculate a Blood Pressure CPR Quality Indicator (BPCPRQI), using features of the arterial blood pressure data as a function of time. Possible features are the diastolic or mean blood pressure over a single or multiple CPR compression(s). With the use of a blood pressure related CPR quality indicator, the actual quality of CPR can be monitored and optimized for specific patients. By doing this, the patient receives optimal care and successful outcome chance improves. An additional advantage of using a blood pressure related CPR quality indicator is the instantaneous effect of the parameter; a change in CPR quality is immediately seen in the quality parameter, without having a delay or time interval to reach steady state. The BPCPRQI may be compared to a criterion, such as a threshold or target interval. Instead of using a fixed threshold or interval, this threshold or interval might change as of trends in the signal over time. The BPCPRQI may be calculated in a number of ways which will be discussed further in the present text. Based on the BPCPRQI the processor may, if the BPCPRQI is below a quality threshold or outside the target interval, transmit a low-quality indication signal. This may be used as an indication that the CPR is not performed satisfactory. Further, if the BPCPRQI is above the threshold or inside the target interval, the processor may transmit a high quality indication signal. This indication may be used to indicate that CPR is performed satisfactory. The system may comprise an indicator unit providing an indication of the blood pressure CPR quality indicator. The BPCPRQI may be used to visually indicate the response from the check, in that the system may comprise a visual indicator configured to provide visual indication of the low quality indication signal and/or high quality indication signal and/or blood pressure CPR quality indicator. Additionally, the current BPCPRQI and or history of the BPCPRQI may be shown to show current CPR quality or trends in CPR quality.

In the present disclosure the optimum blood pressure CPR quality indicator, BPCPRQI, may be defined as the maximum possible value of this indicator. Alternatively the optimum BPCPRQI may be defined as a target BPCPRQI that is related to good CPR physiology that is related to improved CPR outcome. In general a range of good CPR physiology for a diastolic BPCPRQI may be defined to be between 20 and 40 mmHg and the range for good CPR physiology of mean BPCPRQI may be defined to be between 40 mmHg and 80 mmHg.

In the present disclosure trend feedback may be provided to the user, e.g. via a screen or other suitable display.

In the present disclosure history of compression depth and frequency may be linked to the BPCPRQI and specific user feedback may then be given with respect to compression depth and frequency to the user to improve the BPCPRQI.

In an embodiment, the invention provides a system for providing feedback regarding chest compressions in CPR, wherein the system comprises:

a measuring unit providing a measure of arterial blood pressure of a patient, a processor registering data from the measuring unit, the processor being configured to obtain arterial blood pressure of the patient for a time period while CPR is being performed, and the processor being configured to calculate a blood pressure CPR quality indicator using the blood pressure as a function of time, an indicator unit providing an indication of the blood pressure CPR quality indicator, and a sensor for registering depth of compression of CPR and a display for displaying a signal indicating depth of compression, wherein the processor is further configured to indicate that in order to obtain an optimal compression depth, a step up and a step down of compression depth relative to a previously determined optimal compression depth should be performed, wherein the processor is arranged to register:

1) a first blood pressure CPR indicator in response to the previously determined optimal compression depth, 2) a second blood pressure CPR quality indicator in response to a step up in compression depth compared to the previously determined optimal compression depth, and 3) a third blood pressure CPR quality indicator in response to a step down in compression depth compared to the previously determined compression depth, and wherein the processor is arranged to select thereafter a new optimal compression depth based on the first, second and third blood pressure CPR quality indicators obtained, and wherein the new optimal compression depth is selected from the three applied compression depths (i.e. the previously determined optimal compression depth, the step up in compression depth, and the step down in compression depth) is defined as the compression depth with the highest blood pressure CPR quality indicator value or as the smallest compression depth with a blood pressure CPR quality indicator value that exceeds a target blood pressure CPR quality indicator value.

The system according to the first aspect may incorporate any features mentioned in relation to the second and/or third aspects and other features mentioned throughout the present specification.

A second aspect of the present invention relates to an automated resuscitation device comprising a chest compression device to repeatedly compress the chest of a patient, and a feedback device comprising a measuring unit providing a measure of blood pressure of a patient, and a processor registering data from the measuring unit. The processor is configured to obtain blood pressure of the patient for a time period while CPR is being performed on the patient. Further, the processor is configured to calculate a blood pressure CPR quality indicator (BPCPRQI) using features of the blood pressure as a function of time. The automated resuscitation device comprises an indication device for indicating the BPCPRQI. Further the automated resuscitation device contains an algorithm that automatically optimizes CPR compression depth by using feedback from the BPCPRQI on specific times during the CPR. This optimization step could either be performed continuous, on regular time events, or could be initiated by a rescuer (e.g. by a button press). The automated resuscitation device may incorporate any features mentioned in relation to the first and/or third aspect and other features mentioned throughout the present specification.

A third aspect of the present invention relates to a method for providing feedback regarding chest compressions in CPR, using a system comprising a measuring unit providing a measure of blood pressure of a patient, the method comprising the steps of while CPR is being performed on the patient obtaining for a time period blood pressure of the patient, calculating using the blood pressure as a function of time a blood pressure CPR quality indicator (BPCPRQI), and if the BPCPRQI is outside a quality criterion transmitting a low quality indication signal, if the blood pressure CPR quality indicator fulfills the quality criterion transmitting a high quality indication signal.

In general the various aspects of the invention and other features may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

Embodiments of the invention will be described, by way of example only, with reference to the drawings, in which.

DETAILED DESCRIPTION

Figure 1:
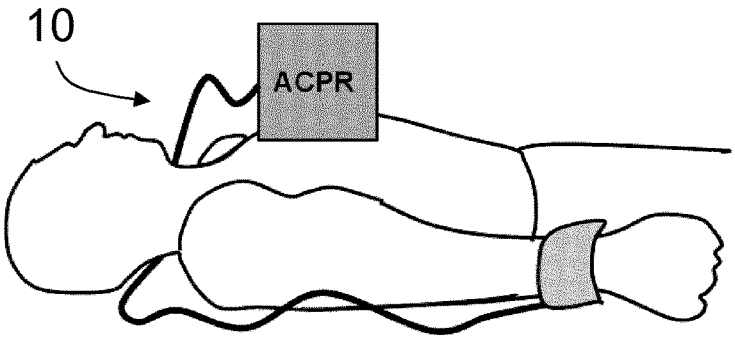
FIGS. 1 and 2 are schematic illustrations of ACPR devices connected to a blood pressure sensor, FIG. 3 schematically outlines illustrated operation of an algorithm, FIG. 4 schematically illustrates blood pressure as a function of time, FIG. 5 schematically outlines illustrated operation of an algorithm.
Figure 2:
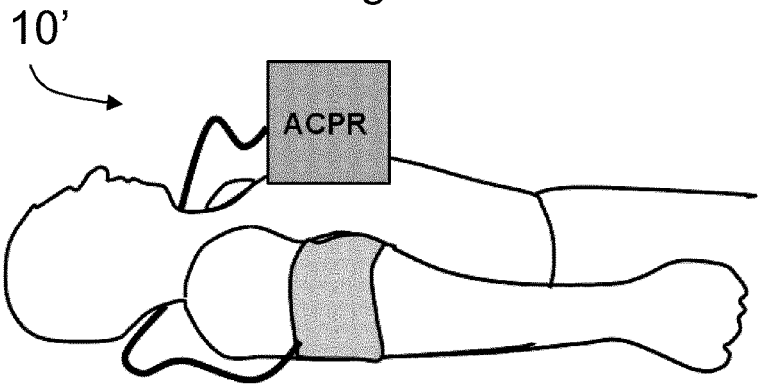

In FIG. 1 a schematic view of an automated CPR device with a system 10 for providing feedback regarding chest compressions in CPR and a blood pressure measuring device, mounted or connected to a patient is shown. The system 10 may be used as a part of other equipment such as automatic resuscitation equipment or as a stand-alone device, providing feedback to a paramedic or another person performing CPR. The system comprises a measuring unit providing a blood pressure CPR Quality indicator (BPCPRQI) of a patient, here in the form of a measurement unit that measures the arterial blood pressure at the wrist. The measuring unit is preferably a non-invasive device, as it is contemplated that the system is to be used in emergencies where fast access to BPCPRQI is needed. Further, a non-invasive measurement is preferred as the system should be useable by all levels of paramedics, and not all paramedics would be able to place invasive BP measurements. In FIG. 2 a schematic view of a system 10' similar to that in FIG. 1 is illustrated. Here a measure for the BPCPRQI is obtained via cuff based measurement on the arm.

The system 10 further comprises a processor registering data from the measuring unit. The processor may be connected to an external memory, such as a RAM or FLASH storage for storing data received from the measuring unit. The processor is configured to obtain arterial blood pressure of the patient for a given time period, while CPR is being performed on the patient. The processor then calculates the blood pressure CPR quality indicator (BPCPRQI) using the blood pressure as a function of time. This indicator is used as a measure of the quality of the CPR operation, i.e. vital organ perfusion, which can be used to improve CPR operation. The BPCPRQI is then checked against a criterion. In one embodiment this criterion may be a threshold, in another embodiment this criterion might be an interval. Furthermore, the BPCPRQI may be continuously monitored, and may be indicated directly to the user to be able to see trends in CPR quality. This can be done, e.g. visually or via an audio signal such as voice or tone. The BPCPRQI may also be continuously monitored by a processor operating an automatic resuscitation device and the ACPR device using the BPCPRQI to optimize CPR compressions.

The system may in some instances comprise a sensor for registering depth of compression of CPR and a display for displaying a signal indicating depth of compression. This will provide visual feedback to a person supervising the CPR.

Description of Simplified Examples of Embodiments

Advantageous Embodiment 1 (CPR Quality on an Emergency Care Monitor)

In a first advantageous embodiment a non-invasive continuous blood pressure CPR Quality Indicator (BPCPRQI) is used (e.g. tonometry). From the continuous arterial blood pressure, the diastolic period is extracted and the diastolic mean is calculated and used as BPCPRQI. The moving average BPCPRQI over some compressions (e.g. 5 compressions) is shown as a trend on the emergency care monitor. On declining trends the rescuer is warned.

Advantageous Embodiment 2 (Personalized and Automated CPR)

Figure 3:
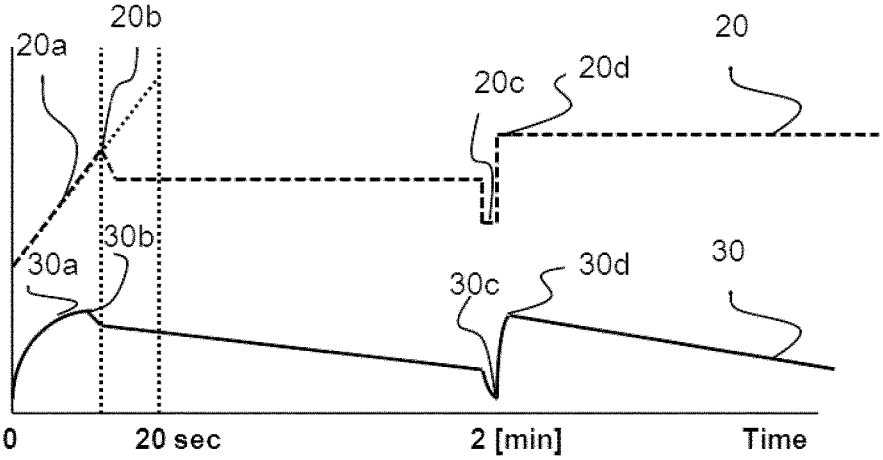

In a second advantageous embodiment a non-invasive continuous arterial blood pressure measure is used (e.g. tonometry). From the continuous blood pressure, the diastolic period is extracted and the diastolic mean is calculated and used as blood pressure CPR Quality indicator (BPCPRQI). At the start of automated CPR, compression depth is ramped up (e.g. by 0.1 cm per compression), starting at a certain starting depth (e.g. 2.0 cm). For every compression the BPCPRQI is monitored. Compressions are being ramped up until the optimum BPCPRQI is reached. During CPR, repeatedly (e.g. every time 2 minutes) a check is done if compression depth is still optimal by doing a single step size (e.g. 0.5 cm) to both sides of the optimum depth for some time (e.g. 10 seconds) and selecting the depth corresponding to the optimal BPCPRQI for the following time interval. The operation of the algorithm outlined here is schematically illustrated in FIG. 3. In this figure, the line 20 represents the compression depth, and the line 30 represents the BPCPRQI. Compression depth is increased at startup (20*a*). This results in an increasing BPCPRQI (30*a*). At some point during the ramp up, the BPCPRQI doesn't increase anymore and even decreases (30*b*). At that point of change, the compression depth is optimal and that depth is used for the next 2 minutes (20*b*). After 2 minutes a check is done if compression depth is still optimal, by first going to a 0.5 cm lower compression depth for 10 seconds (20*c*). This results in an decreasing BPCPRQI (30*c*). Another step to 0.5 cm higher of the starting depth is done (20*d*) which results in a higher BPCPRQI (30*d*). The compression depth belonging to the optimal BPCPRQI is used for the next 2 minutes of CPR.

Advantageous Embodiment 3 (Personalized and Automated CPR)

Figure 5:
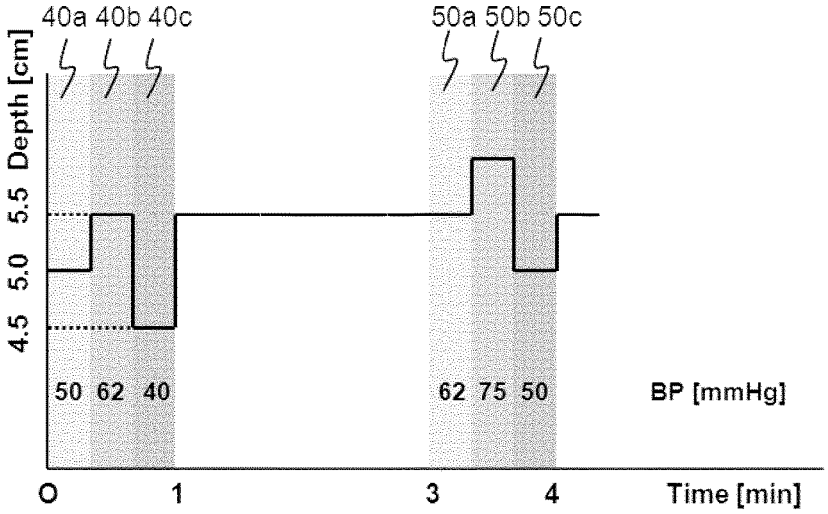

In a third advantageous embodiment a cuff based (non-invasive and non-continuous) arterial blood pressure measure is used as blood pressure CPR Quality indicator (BPCPRQI). Automated CPR is started at guideline compression depth (i.e. 5.0 cm). Mean blood pressure is used as BPCPRQI. Optimum BPCPRQI is defined as achieving a certain minimum target value of BPCPRQI. A cuff measurement is done regularly (e.g. every 2 minutes) at the current compression depth for the time it takes to do a cuff BP measurement (e.g. 20 seconds).Thereafter compression depth is increased a single step size (e.g. 0.5 cm) and another cuff measurement is done. Thereafter a decrease in step size from the optimum is done and another cuff measurement is done. The smallest compression depth that results in a BPCPRQI value bigger than the target value is used as new optimum depth. If only values lower than the target value is found, the depth that results in the highest BPCPRQI value is used for the following time interval. The operation of the algorithm outlined here is schematically illustrated in FIG. 5. A target BPCPRQI of 60 mmHg is used. Here, at the start T 0, the current compression depth results in a BPCPRQI of 50 mmHg, 40*a*. At half a cm higher a BPCPRQI of 62 mmHg is measured and at half a cm lower a BPCPRQI of 40 mmHg is measured, see 40*b* and 40*c*. As the highest compression depth is the only one that reaches the target BPCPRQI of 62 mmHg that compression depth is used for the next 2 minutes. In the second optimization interval, from T 3 to T 4, the current compression depth (which is half a cm higher than before) again results in a BPCPRQI of 62 mmHg, 50*a*. The half cm higher compression depth results in a BPCPRQI of 75 mmHg, 50*b*, the half cm lower compression depth results in a BPCPRQI of 50 mmHg, 50*c*. While the highest compression depth results in the highest BPCPRQI, the middle depth is the lowest depth that results in the BPCPRQI being higher than the target and is therefore used as depth for the next 2 minutes.

Figure 6:
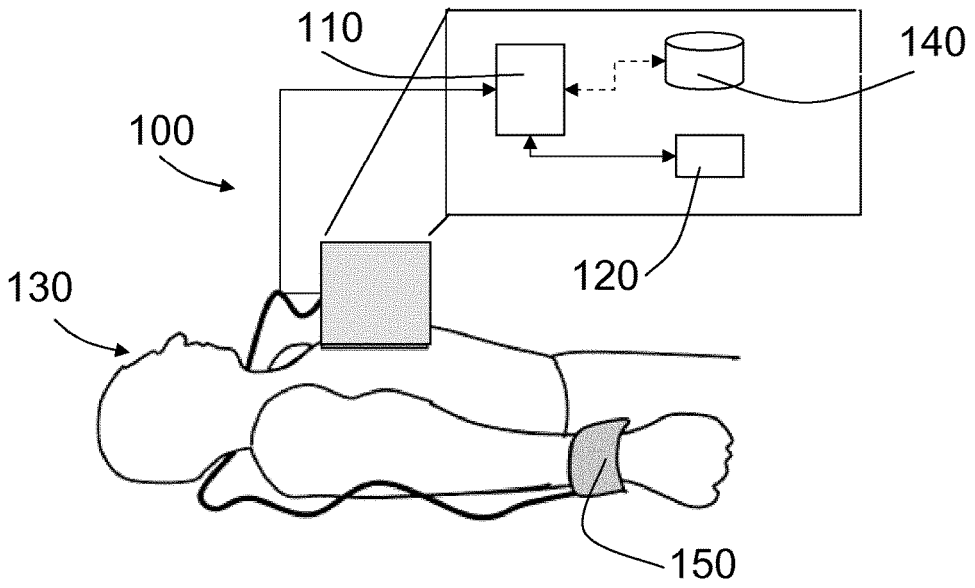
FIG. 6 is a schematic view of a system for providing feedback regarding CPR, where a zoom box illustrates parts of the system.

Returning to the figures, FIG. 6 schematically illustrates a system 100 having a processor 110 connected to an indicator 120. The processor 110 receives signals indicative of the blood pressure of the patient 130. An external memory 140 is used for storing received data for processing. In this view blood pressure is obtained via the cuff 150, but any other suitable means may be used, as discussed elsewhere in the present text. Other suitable means for obtaining blood pressure may be used, e.g. a continuous invasive pressure catheter, a non-invasive regular cuff-measurement or a non-invasive continuous measurement or a combination thereof.

If the blood pressure CPR quality indicator is below the quality threshold, i.e. outside an acceptable range relative to the criterion or in case that there is a too large decreasing trend, the processor is configured to transmit or emit a low quality indication signal. This low quality indication signal may be used by other units such as an indicator, either visual or audible to indicate to a person performing CPR that the CPR operation is not going as planned. The signal may also be forwarded to a unit responsible for performing CPR automatically. If the blood pressure CPR quality indicator on the other hand is above the threshold, i.e. within an acceptable range relative to the criterion, the processor may transmit a high quality indication signal, or the indication of high quality may be absence of a signal.

Furthermore, the blood pressure CPR quality indicator may be monitored for a period of time, and if the blood pressure CPR quality indicator for that time period shows a negative trend, a decreasing CPR quality-signal may be transmitted. This will further help the person performing the CPR to detect that the CPR is not going as desired.

The CPR quality indicator may be based on diastolic blood pressure. Coronary perfusion pressure (CPP) has shown to be related to blood flow and outcome of cardiac arrest. This parameter is calculated by subtracting right atrial blood pressure from aortic blood pressure during the diastolic phase of a CPR compression. Experiments have shown that Right Atrial pressure is very low during diastolic phase of CPR compressions which makes the diastolic aortic pressure also a measure of CPR quality. Instead of using the diastolic blood pressure, the mean blood pressure could be used as indicator of CPR quality.

The Blood Pressure CPR Quality Indicator may be determined based on diastolic blood pressure in various ways:

The lowest point in the blood pressure curve during the diastolic phase.

The average pressure in the blood pressure curve during diastolic phase.

The last value of the diastolic phase (end diastole).

The average diastolic pressure seems to a good candidate to use for CPR quality as the interest is in the average perfusion of the heart and not some incidental peak value.

Figure 4:
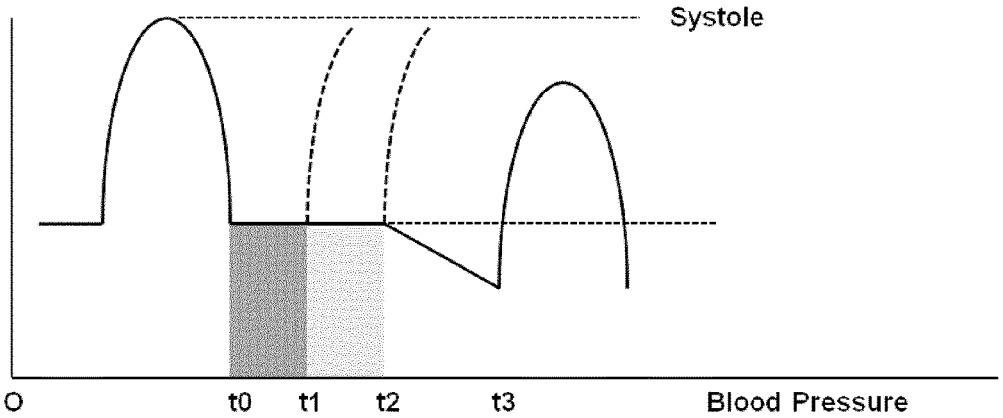

Further, the slope of the diastolic pressure, when monitored over a period of time, could be used to be used to tune the frequency of chest compressions. As long as the diastolic pressure remains steady, there is no need to initiate a next compression. However, when the diastolic pressure decreases, a following compression should be initiated soon. This is indicated in FIG. 4, where the slope of diastolic pressure is used to tune compression frequency. At t0 diastole starts. There is no need to start compressions at t1 as diastolic pressure is steady. Somewhere between t2 and t3 a next compression should start as the diastolic pressure is decreasing Different sensor modalities can be used for measuring blood pressure, including, but not limited to: invasive catheters to measure continuous aortic blood pressure, an occluding cuff (Riva-Rocci) method to measure blood pressure on regular intervals in which the diastolic value can be determined by Korotkoff sounds or oscillometry, tonometry or volume clamp methods to measure blood pressure in a continuous non-invasive way. Also, a combination of these may be applied. The use of a continuous, noninvasive blood-pressure measurement seems most valuable, because it provides clinical ease-of-use and beat-to-beat (i.e. compression-to-compression) information. For all sensor modalities filtering/averaging techniques may be used to improve the accuracy of the signal. When using a non-continuous measure, only individual diastolic values over a certain time interval are available (i.e. no average over time or end diastolic) and possible feedback can only be done on periodic intervals (i.e. not beat-to-beat).

Different sensor locations might be used for measuring blood pressure, including but not limited to the upper arm, the wrist, the ankle and a fingertip.

Definition of Optimum CPR Quality.

Chest compression depth may be adjusted to optimize CPR quality. Optimum CPR quality may be defined as the maximum value of the Blood Pressure CPR Quality Indicator (BPCPRQI). In this case, the Blood Pressure measurement does not have to be absolute as higher is always better.

Optimum CPR quality may be defined as a value of the Blood Pressure CPR Quality Indicator (BPCPRQI) that is related with good resuscitation outcome. Then the minimum chest compression depth that reaches this value is selected as the optimum compression depth. For CPP a value of bigger than 15 mmHg is correlated with high Return Of Spontaneous Circulation (ROSC, i.e. the start of spontaneous activity of the heart), a diastolic blood pressure should be around this value or preferably somewhat larger (20-40 mmHg, such as 25-35 mmHg). When using mean blood pressure values, this pressure should be approximately 60 mmHg (between 40-80 mmHg). With this method absolute values have to be measured (compared to relative values for maximization), so a sensor in this method must be able to measure absolute values, possibly after calibration.

Use Cases for the Blood Pressure CPR Quality Indicator

The Blood Pressure CPR Quality Indicator (BPCPRQI) may be used in combination with/included in an ACPR device. The automated resuscitation device (ACPR) repeatedly compresses the chest of a patient. The system comprises a processor configured to operate the chest compression device based on the BPCPRQI, thereby optimizing CPR. This is done by regularly (e.g. every 3 minutes) performing a step up and a step down of compression depth relative to a previously determined optimal compression depth and selecting a new optimal compression depth based on the three CPR quality indicators obtained. For instance the new optimal compression depth may be selected from the three applied compression depths is defined as the depth with the highest blood pressure CPR quality indicator value or as the smallest depth with a blood pressure CPR quality indicator value that exceeds a target blood pressure CPR quality indicator value. This establishes a self-contained unit to be used by health professionals, or even untrained persons. A processor may indicate that, in order to obtain an optimal compression depth, a step up and a step down of compression depth relative to a previously determined optimal compression depth should be performed. A new optimal compression may then be selected depth based on the three CPR quality indicators obtained. In other embodiments a processor may be configured to provide such indication to a user, who then performs the steps.

The Blood Pressure CPR Quality Indicator (BPCPRQI) may be used in combination with/included in an emergency care monitoring device. The monitor device may include visual and/or audio feedback to the health care person, or other, performing CPR so that the person may improve his or her CPR of the patient, for the benefit of the patient.

In an Emergency Care monitor, the BPCPRQI could be used as a visual indicator of CPR quality which could be shown in real time on the monitor screen.

In an Emergency Care monitor, besides showing the BPCPRQI, feedback (i.e. a warning signal) to the user could be given in case the BPCPRQI is falling (trend monitoring).

In an Emergency Care monitor, besides showing the BPCPRQI and warning the rescuer, specific feedback (compress (less/more, deep/fast) could be given to the rescuer. In this case the history of the quality parameter should be logged and linked to depth and frequency information.

In an ACPR device, the BPCPRQI could be included similarly as in the previous points.

In an ACPR device, the BPCPRQI could be included in a feedback system that tunes the compression depth on the start of ACPR, during ramp up of compressions. During ramp up, the compression depth is increased until the optimum in BPCPRQI is reached (within certain limits).

In an ACPR device, the BPCPRQI could be included in a closed loop feedback system, that on certain time intervals (e.g. every minute) or on user interaction does an automatic optimization of compression depth, by doing a single step size (e.g. 0.5 cm) to both sides of the optimum for a certain amount of time (e.g. 10 seconds), determines BPCPRQI for that time interval and selects compression depth with the highest BPCPRQI for the following time period.

Figure 7:
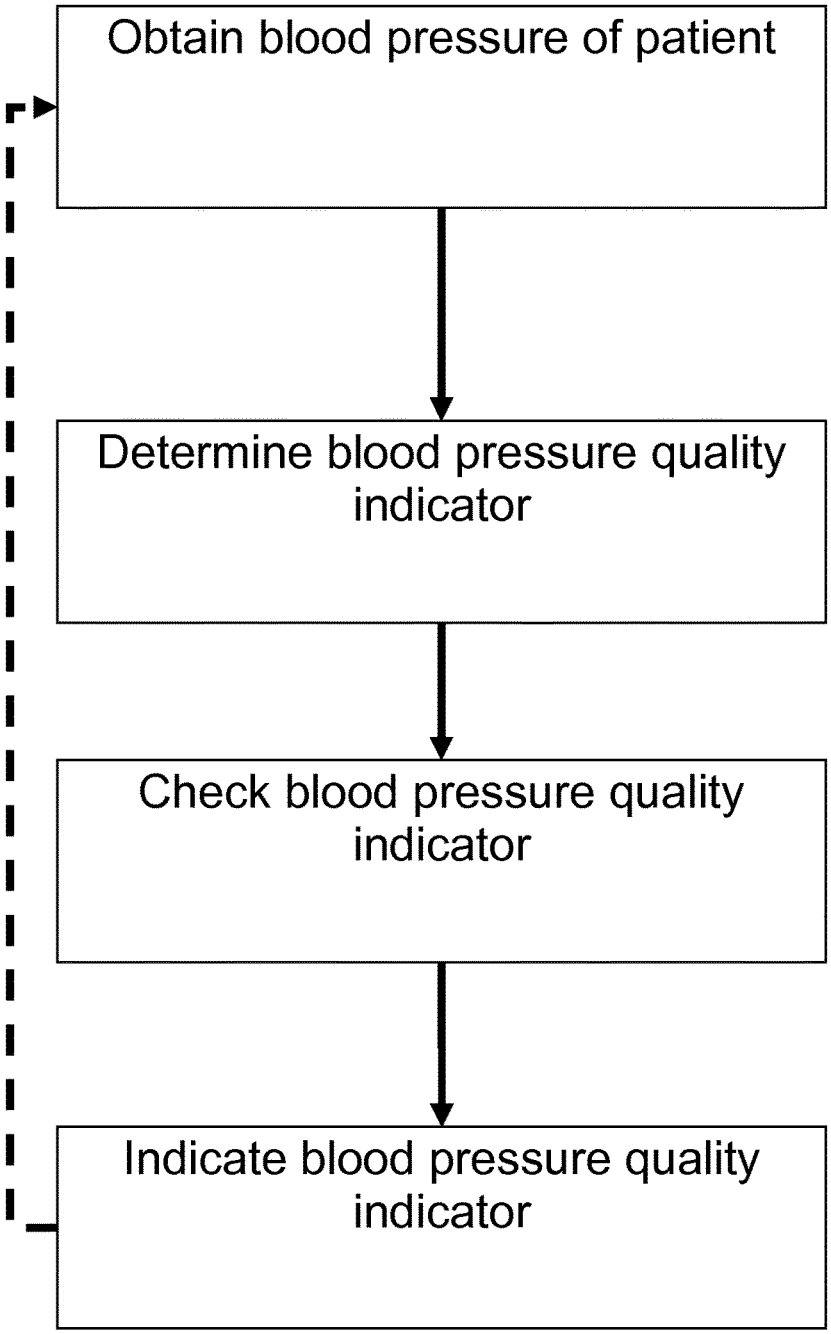
FIG. 7 is a schematic illustration of steps of a method.

FIG. 7 is a schematic illustration of steps of a method for providing feedback regarding chest compressions in CPR. The method is preferably performed using a system comprising a measuring unit providing a measure of arterial blood pressure of a patient, such as discussed above. The method may be implemented in software for execution on a processor in the system. The method comprises the step of obtaining arterial blood pressure of the patient for a period of time while CPR is being performed on the patient. Further, the method comprises the step of calculating a blood pressure CPR quality indicator using the blood pressure as a function of time, and indicating the blood pressure CPR quality indicator.

The method may include any of the steps mentioned in relation to operating the systems as described in the present specification.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A system for providing feedback regarding chest compressions in CPR, wherein the system comprises:

a measuring unit for providing a measure of arterial blood pressure of a patient, a processor for registering data from the measuring unit, the processor being configured to obtain arterial blood pressure of the patient for a time period while CPR is being performed, and configured to calculate a blood pressure CPR quality indicator using the obtained arterial blood pressure as a function of time, an indicator unit for providing an indication of the blood pressure CPR quality indicator, and a sensor for registering a depth of compression of CPR and a display for displaying a signal indicating the depth of compression, characterized in that the processor is further configured to operate in conjunction with the sensor, during an optimization interval, for obtaining an optimal compression depth based on (i) a first CPR quality indicator obtained in response to CPR with a previously determined optimal compression depth, (ii) a second CPR quality indicator obtained in response to continued CPR with a step up in compression depth relative to the previously determined optimal compression depth, and (iii) a third CPR quality indicator obtained in response to further continued CPR with a step down in compression depth relative to the previously determined optimal compression depth, and selecting a new optimal compression depth for a subsequent time interval based on the first, second and third CPR quality indicators, and wherein the new optimal compression depth, selected from among three applied compression depths that include the previously determined optimal compression depth, the step up in compression depth relative to the previously determined compression depth, and the step down in compression depth relative to the previously determined compression depth, is defined as a depth with a highest blood pressure CPR quality indicator value or as a smallest depth with a blood pressure CPR quality indicator value that exceeds a target blood pressure CPR quality indicator value.

2. The system according to claim 1, wherein responsive to the blood pressure CPR quality indicator having a value below a quality threshold or outside a target interval, the processor is further for transmitting a low quality indication signal, wherein responsive to the blood pressure CPR quality indicator having a value above the threshold or inside the target interval, the processor is further for transmitting a high quality indication signal, and further wherein responsive to the blood pressure CPR quality indicator having a value that for a time period shows a negative trend, the processor is further for transmitting a decreasing CPR quality signal.

3. The system according to claim 1, wherein the indicator unit is a visual indicator configured to provide visual indication of a low quality indication signal and/or a high quality indication signal and/or a present blood pressure CPR quality indicator.

4. The system according to claim 1, wherein the measurement unit for providing the measure of arterial blood pressure of the patient is obtained via a continuous invasive pressure catheter, a non-invasive regular cuff-measurement or a non-invasive continuous measurement or a combination thereof.

5. The system according to claim 1, wherein diastolic blood pressure is used for calculating the blood pressure CPR quality indicator or a mean diastolic blood pressure value over a period of time is used as the blood pressure CPR quality indicator, where target levels or intervals for the diastolic blood pressure are between 20 and 40 mmHg and target levels or intervals for the mean diastolic blood pressure are between 40 and 80 mmHg.

6. The system according to claim 1, wherein the arterial blood pressure includes a diastolic blood pressure determined by a minimum value during a diastolic phase of a blood pressure signal of the measuring unit or an average value of the diastolic phase of the blood pressure signal or an end value of the diastolic phase of the blood pressure signal.

7. An automated resuscitation device comprising:

a chest compression device to repeatedly compress the chest of a patient, the system according to claim 1 to measure quality of CPR, and the processor, or a separate processor, configured to operate the chest compression device on regular time intervals or by user interaction, based on a measured quality of CPR by the system, wherein the measurement unit for providing the measure of arterial blood pressure of the patient is obtained via a continuous invasive pressure catheter, a non-invasive regular cuff-measurement or a non-invasive continuous measurement or a combination thereof.

8. A computer program stored on a non-transitory computer readable medium, wherein the computer program is adapted to, when executed in a processor of a system comprising a measuring unit for providing a measure of blood pressure of a patient and an indicator unit for providing an indication of a blood pressure CPR quality indicator, implement the steps of:

while CPR is being performed on the patient, obtaining blood pressure of the patient for a time period, calculating, using the blood pressure as a function of time, the blood pressure CPR quality indicator, and if the blood pressure CPR quality indicator is outside a quality criterion, then transmitting a low quality indication signal, and if the blood pressure CPR quality indicator fulfills the quality criterion the threshold, then transmitting a high quality indication signal, registering a depth of compression of CPR and displaying a signal indicating the depth of compression, operating, during an optimization interval, to obtain an optimal compression depth based on (i) a first CPR quality indicator obtained in response to CPR with a previously determined optimal compression depth, (ii) a second CPR quality indicator obtained in response to continued CPR with a step up in compression depth relative to the previously determined optimal compression depth, and (iii) a third CPR quality indicator obtained in response to further continued CPR with a step down in compression depth relative to the previously determined optimal compression depth, and selecting a new optimal compression depth for a subsequent time interval based on the first, second and third CPR quality indicators, wherein the new optimal compression depth, selected from among three applied compression depths that include the previously determined optimal compression depth, the step up in compression depth relative to the previously determined compression depth, and the step down in compression depth relative to the previously determined compression depth, is defined as a depth with a highest blood pressure CPR quality indicator value or as a smallest depth with a blood pressure CPR quality indicator value that exceeds a target blood pressure CPR quality indicator value.

9. The computer program of claim 8, wherein the high quality indication signal is transmitted when the blood pressure CPR quality indicator is in a certain high quality range and the low quality indication signal is transmitted if the blood pressure CPR quality indicator is not in the certain high quality range.

10. The computer program of claim 8, wherein the system comprises a visual indicator and/or an audio transmitter, the computer program is further adapted to implement the step of indicating a respective low quality indication signal or high quality indication signal via the visual indicator and/or audio transmitter in response to the blood pressure CPR quality indicator having (i) a respective value below a quality threshold or outside a target interval, or (ii) a respective value above the quality threshold or inside the target interval, and/or wherein responsive to the blood pressure CPR quality indicator having a value that for a time period shows a negative trend, transmitting a decreasing CPR quality signal.

11. The computer program of claim 8, wherein diastolic blood pressure is used for calculating the blood pressure CPR quality indicator or a mean diastolic blood pressure value over a period of time is used as the blood pressure CPR quality indicator.

12. The computer program of claim 11, wherein the diastolic blood pressure is determined by a minimum value during a diastolic phase of a blood pressure signal of the measuring unit or an average value of the diastolic phase of the blood pressure signal or an end value of the diastolic phase of the blood pressure signal.

13. A method for providing feedback regarding chest compressions in CPR, using a system comprising a measuring unit providing a measure of blood pressure of a patient, the method comprising:

while CPR is being performed on the patient, obtaining blood pressure of the patient for a time period, calculating using the blood pressure as a function of time, a blood pressure CPR quality indicator, and if the blood pressure CPR quality indicator is outside a quality criterion, then transmitting a low quality indication signal, and if the blood pressure CPR quality indicator fulfills the quality criterion the threshold, then transmitting a high quality indication signal, registering a depth of compression of CPR and displaying a signal indicating the depth of compression, operating, during an optimization interval, to obtain an optimal compression depth based on (i) a first CPR quality indicator obtained in response to CPR with a previously determined optimal compression depth, (ii) a second CPR quality indicator obtained in response to continued CPR with a step up in compression depth relative to the previously determined optimal compression depth, and (iii) a third CPR quality indicator obtained in response to further continued CPR with a step down in compression depth relative to the previously determined optimal compression depth, and selecting a new optimal compression depth for a subsequent time interval based on the first, second and third CPR quality indicators, wherein the new optimal compression depth, selected from among three applied compression depths that include the previously determined optimal compression depth, the step up in compression depth relative to the previously determined compression depth, and the step down in compression depth relative to the previously determined compression depth, is defined as a depth with a highest blood pressure CPR quality indicator value or as a smallest depth with a blood pressure CPR quality indicator value that exceeds a target blood pressure CPR quality indicator value.

14. The method of claim 13, wherein the high quality indication signal is transmitted when the blood pressure CPR quality indicator is in a certain high quality range and the low quality indication signal is transmitted if the blood pressure CPR quality indicator is not in the certain high quality range; and/or wherein the system comprises a visual indicator and/or an audio transmitter, the method comprising indicating a respective low quality indication signal or high quality indication signal via the visual indicator and/or audio transmitter in response to the blood pressure CPR quality indicator having (i) a respective value below a quality threshold or outside a target interval, or (ii) a respective value above the quality threshold or inside the target interval, and/or wherein responsive to the blood pressure CPR quality indicator having a value that for a time period shows a negative trend, transmitting a decreasing CPR quality signal.

15. The method of claim 13, wherein diastolic blood pressure is used for calculating the blood pressure CPR quality indicator or a mean diastolic blood pressure value over a period of time is used as the blood pressure CPR quality indicator; and wherein the diastolic blood pressure is determined by a minimum value during a diastolic phase of the blood pressure signal or an average value of the diastolic phase of the blood pressure signal or an end value of the diastolic phase of the blood pressure signal.

* * * * *